US007044207B1

(12) United States Patent
Guidat et al.

(10) Patent No.: US 7,044,207 B1
(45) Date of Patent: May 16, 2006

(54) HEAT EXCHANGER AND RELATED EXCHANGE MODULE

(75) Inventors: Roland Guidat, Nancy (FR); Michel Claudel, Sarrebourg (FR); Florent Noel, Harskirchen (FR)

(73) Assignee: Zie Pack, Courbevoie (FR)

( * ) Notice: Subject to any disclaimer, the term of this patent is extended or adjusted under 35 U.S.C. 154(b) by 0 days.

(21) Appl. No.: 10/048,371

(22) PCT Filed: Jul. 26, 2000

(86) PCT No.: PCT/FR00/02153

§ 371 (c)(1),
(2), (4) Date: May 7, 2002

(87) PCT Pub. No.: WO01/07854

PCT Pub. Date: Feb. 1, 2001

(30) Foreign Application Priority Data

Jul. 27, 1999 (FR) ..... 99 09706

(51) Int. Cl.
*F28F 3/12* (2006.01)
*B21D 53/04* (2006.01)

(52) U.S. Cl. ..... 165/170; 165/166; 165/167

(58) Field of Classification Search ..... 165/170, 165/164, 178, 157, 166, 167, 162; 29/890.039, 29/890.042

See application file for complete search history.

(56) References Cited

U.S. PATENT DOCUMENTS

| | | | | |
|---|---|---|---|---|
| 2,877,000 | A * | 3/1959 | Person | 165/159 |
| 3,590,917 | A * | 7/1971 | Huber et al. | 165/167 |
| 4,473,111 | A * | 9/1984 | Steeb | 165/153 |
| 5,111,878 | A * | 5/1992 | Kadle | 165/153 |
| 5,125,453 | A * | 6/1992 | Bertrand et al. | 165/153 |
| 5,137,082 | A * | 8/1992 | Shimoya et al. | 165/153 |
| 5,228,515 | A * | 7/1993 | Tran | 165/166 |
| 5,318,114 | A * | 6/1994 | Sasaki | 165/176 |
| 6,161,616 | A * | 12/2000 | Haussmann | 165/153 |
| 6,241,011 | B1 * | 6/2001 | Nakamura et al. | 165/153 |
| 6,289,977 | B1 | 9/2001 | Claudel et al. | 165/157 |

FOREIGN PATENT DOCUMENTS

| | | |
|---|---|---|
| DE | 24 50 739 | 4/1976 |
| DE | 196 39 115 | 3/1998 |
| EP | 0 289 915 | 11/1988 |
| EP | 0 694 353 | 1/1996 |
| FR | 2754595 | 4/1998 |
| GB | 228111 | 9/1925 |
| GB | 1286446 | 9/1972 |
| WO | WO 97/21062 | 6/1997 |

* cited by examiner

*Primary Examiner*—Tho Duong
(74) *Attorney, Agent, or Firm*—Greer, Burns & Crain, Ltd.

(57) ABSTRACT

A heat exchange module is disclosed comprising two metal sheets welded along weld lines defining between them a group of channels disposed side by side substantially in a common plane, intended to be passed through by an exchange fluid and, from the fluidic point of view, being in parallel with each other between two connection orifices of the module. The group of channels has a generally U-shape configuration, which connects together the said connection orifices that are laterally separated from each other.

39 Claims, 7 Drawing Sheets

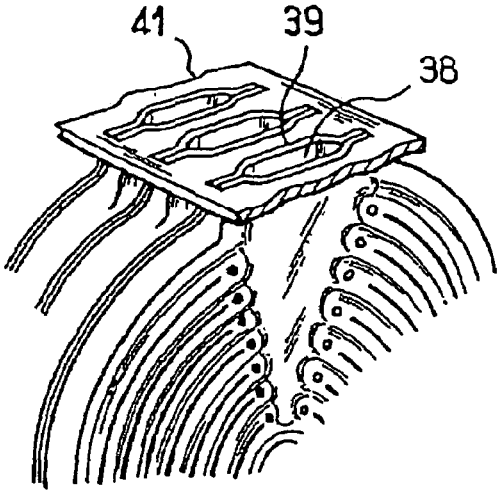
FIG_6
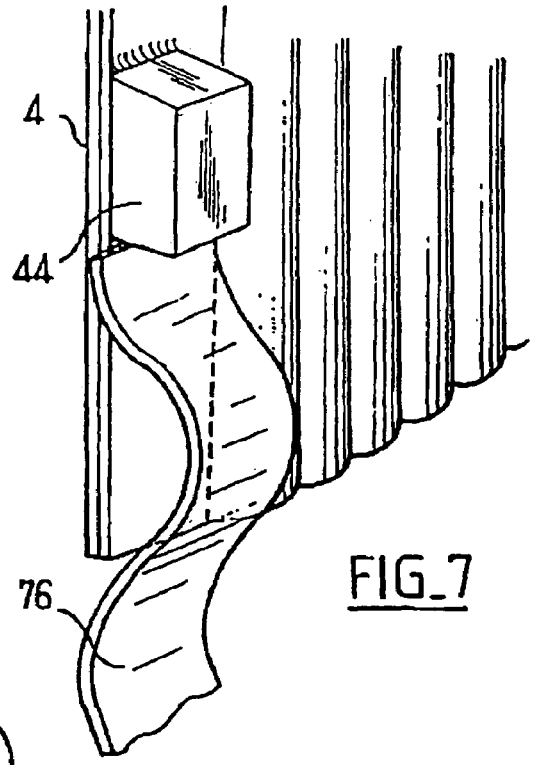
FIG_7
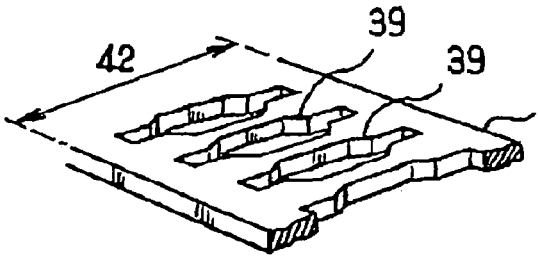
FIG_5
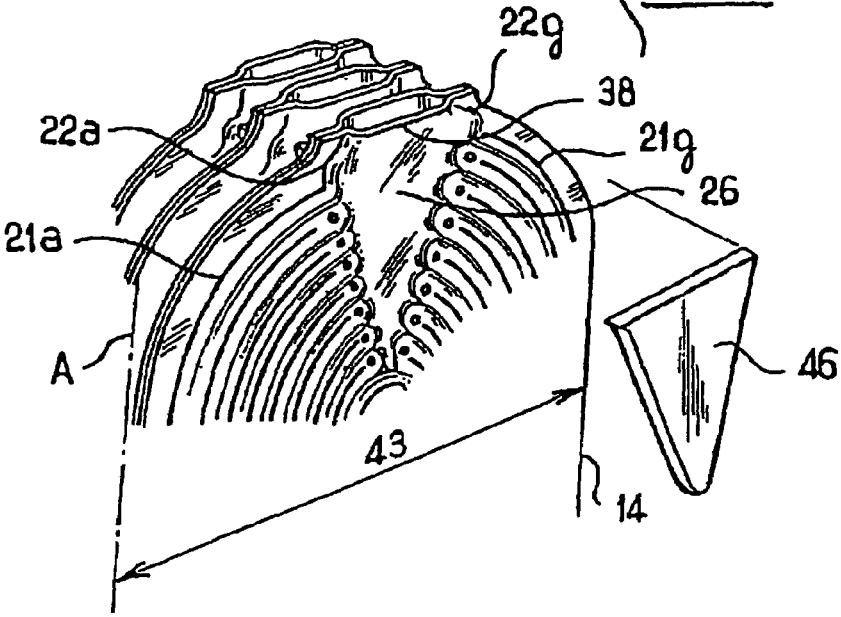

FIG_8
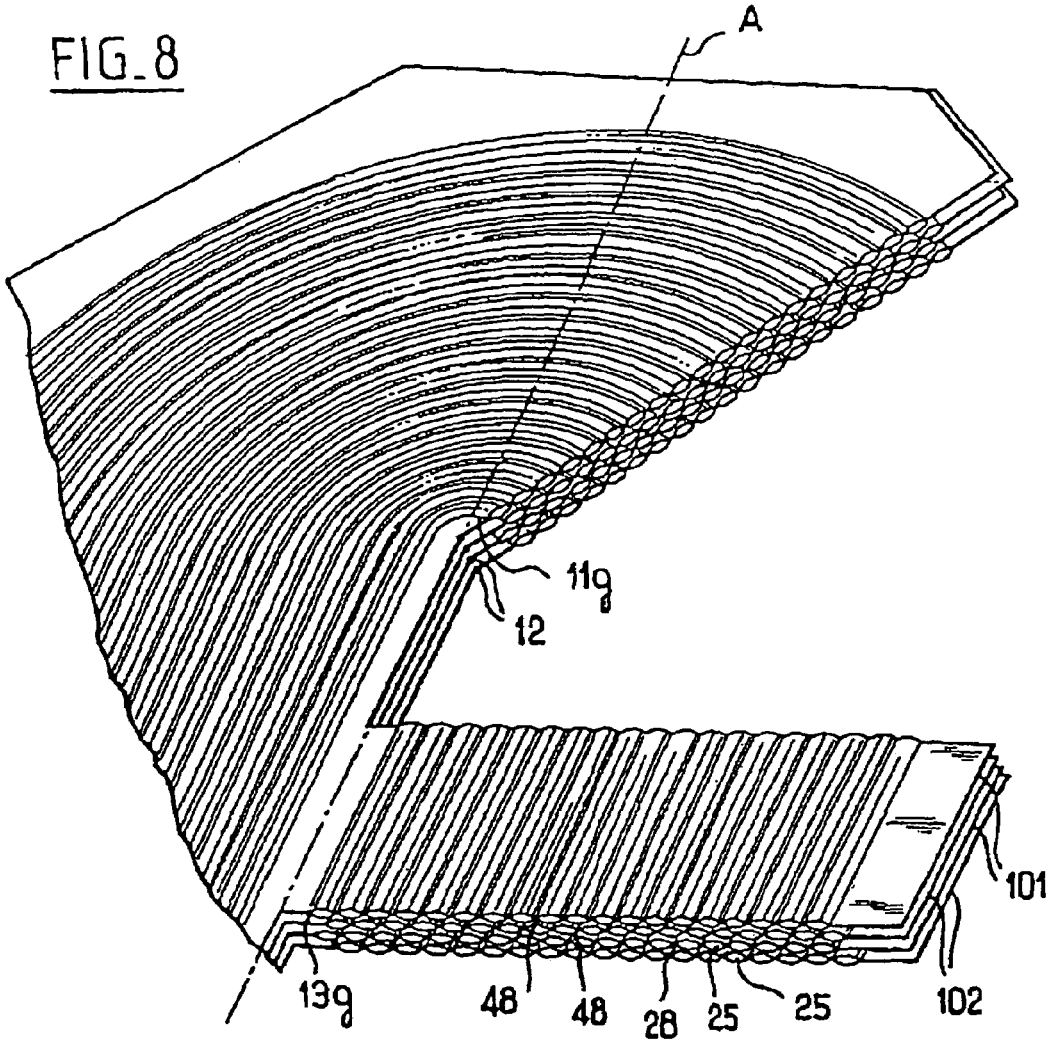
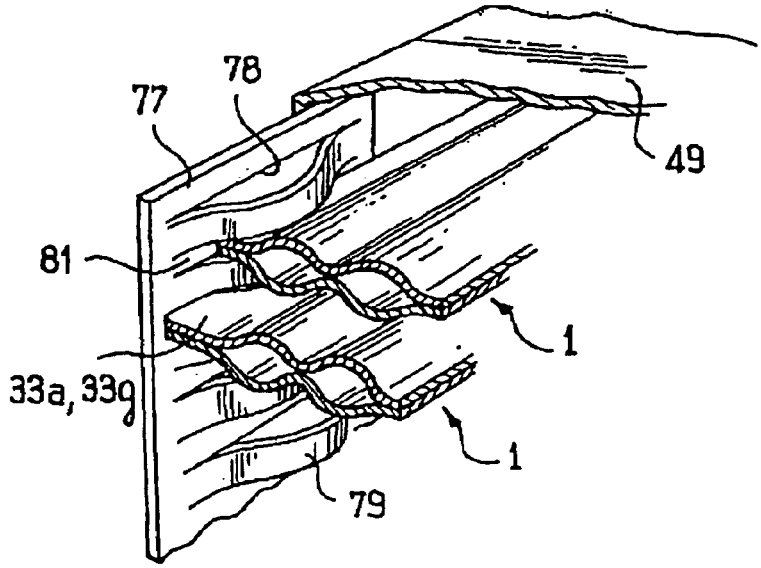
FIG_14

HEAT EXCHANGER AND RELATED EXCHANGE MODULE

The present invention relates to a heat exchange module intended to form part of the thermally active core of a heat exchanger.

The present invention also relates to a heat exchanger equipped with such a module.

WO-A-98/16 786 describes an exchanger whose core consists of a stack of two-panel modules. Each module consists of two metal sheets defining between them a series of longitudinal and parallel channels conveying a first exchange fluid from one end to the other of the modules. The production method of such modules consists in laser welding two flat metal sheets along longitudinal and parallel lines intended to form the separations between the channels. A peripheral weld closes the space between the two metal sheets with the exception of a nozzle for the injection of water under pressure. The module is formed by injecting water under pressure between the two panels in order to produce an inflation of the two metal sheets between the weld seams.

The modules thus produced are stacked in such a way that the outer surfaces of neighbouring modules are pressed against one another along the peaks of the channels. In this way, between the modules there are formed other channels provided for the flow of the second heat exchange fluid, generally in the opposite direction with respect to that of the first exchange fluid.

This known exchanger has a high performance since it procures for both of the exchange fluids the advantages of flow in quasi-tubular channels, in particular with a low pressure loss.

Such exchangers can be used in particular in applications where the flow rates are very high, in particular in oil refineries, in particular so that a petroleum fluid entering a processing apparatus is preheated with the heat provided by the fluid having just undergone the processing, in order that the thermal cost of the processing is limited simply to the provision of a complement. Such exchangers can be of considerable size, of the order of 15 to 20 meters high, the flow of fluids being in the vertical direction in order to save ground surface area.

A construction of such height gives rise to high structural costs for the mechanical stability, the heat insulation with respect to the exterior and the fluid connections.

The purpose of the invention is to allow the production of much more compact exchangers whilst also having high performance.

BRIEF DESCRIPTION OF THE INVENTION

According to the invention, the heat exchange module including two metal sheets welded along weld lines defining between them a group of channels disposed side by side substantially in a common plane, intended to be passed through by an exchange fluid and, from the fluidic point of view, being in parallel with each other between two connection orifices of the module, is characterized in that the group of channels has a generally U-shape configuration, which connects together the connection orifices that are laterally separated from each other.

For a same overall channel length, the module according to the invention is twice as short and therefore makes it possible, for example in a vertical application, to produce an exchange tower of approximately half the height. In comparison with such a saving in height, the slightly increased ground area requirement is a negligible disadvantage. It is even observed that the tower, being both less high and of greater base area, is consequently much more squat and therefore naturally stable from the mechanical point of view.

The advantages of the invention are not limited to tower-type exchangers. For example, an exchanger according to the invention is particularly advantageous when the second fluid flows between the modules in a transverse direction with respect to the legs of the U-shape. By means of the invention, each stream of one of the exchange fluids meets twice in succession, and no longer just once, the path followed by a stream of the other exchange fluid.

The invention is not limited to a single U-shape configuration. It is possible to conceive that the channels are extended by a third longitudinal leg connecting with one of the two preceding ones by a second 180° bend in the opposite direction to that of the first one, and so on.

When the number of legs is even, and in particular when it is equal to two, one of the big advantages which is obtained is that all of the fluidic connections are grouped at one of the ends of the exchanger. In particular, in the tower disposition, all of the fluidic connections can be grouped at the base of the tower. This simplifies the production of the exchanger and reduces its cost.

An important aspect of the present invention also consists in having improved the path of the first exchange fluid at each of its ends in the modules. The difficulty is to distribute the first exchange fluid as evenly as possible without forming a zone at the ends of the channels that would be mechanically unstable, for example having little resistance to pressure, or on the contrary mechanically too stable and which would for example prevent, during the hydroforming, the correct inflation of the channels in the vicinity of their ends.

According to this aspect of the invention, the heat exchange module including two metal sheets welded along weld lines defining between them a group of channels disposed side by side substantially in a common plane, intended to be passed through by an exchange fluid whilst being, from the fluidic point of view, parallel with each other between two connection orifices of the module, is characterized in that, starting from a longitudinal region, the channels have a converging region which incurves towards a distribution chamber connecting a first end of the channels with the respective one of the two connection orifices of the module for connection with the exterior.

In this way, the channels converge towards the distribution chamber. This makes it possible to reduce the size of the distribution chamber and therefore to reduce the mechanical problems that it is likely to produce. At the same time, the convergence contributes to the evenness of distribution of the flows. The distribution chamber is bordered by channel openings over a major portion of its periphery, which contributes to its correct forming and to a good stability of its shape.

It is particularly advantageous that the convergent regions of the channels follow a path shaped like a segment of circle, all of the segments of circle preferably having substantially the same centre.

In general, one of the very significant innovative aspects of the present invention, which can equally well be found in the preferred embodiment of the U-shape bend and in the preferred embodiment of the end zone of the channels, is the production of curved weld seams, preferably circular, making it possible to produce channels by hydroforming that are themselves curved and preferably circular and having a substantially preserved cross-section.

One of the difficulties of hydroforming is that, during the inflation, certain zones constitute stiffeners preventing the correct deformation of other zones. Surprisingly, the circular channels have not caused the appearance of such a phenomenon in a disadvantageous way. A particular advantage has even been observed: the channels that have to form a bend of very small radius inflate less well than the channels making a bigger bend and this automatically compensates for the fact that the fluid flowing through the channels of greater radius has a longer path to travel. The effect is the reverse for the channels reserved for the second exchange fluid flowing between the modules, but this is not harmful if the relative disposition of the modules allows the second fluid to pass from one channel to the other.

According to a second aspect of the invention, the heat exchanger is characterized in that it includes:

- a stack of heat exchange modules according to the first aspect, installed in a cover in such a way that the ends of the U-shape configuration are directed on a same side of the stack, these modules defining, between them and inside the cover, passages for a second exchange fluid;
- first connection means for connecting the connection orifices of the modules with a first external circuit and;
- second connection means for connecting the passages with a second external circuit.

Other features and advantages of the invention will furthermore emerge from the following description, relating to non-limitative examples.

DETAILED DESCRIPTION OF THE DRAWINGS

In the appended drawings:

FIG. 5 is a partial exploded view showing the assembly of the modules in order to form the core;

FIG. 6 is a partial view after the assembly;

FIG. 7 is a detail view in perspective, with tear-aways, showing the spacing arrangement between the modules in the core;

FIG. 8 is a perspective view of several modules stacked in the core, with tear-aways;

FIG. 14 is a partial perspective view, with tear-aways, illustrating the means of positioning modules transversely with respect to their own plane;

Figures 2, 3, 4, 9, 10, 13, 15, 16, 17, 18, 19:
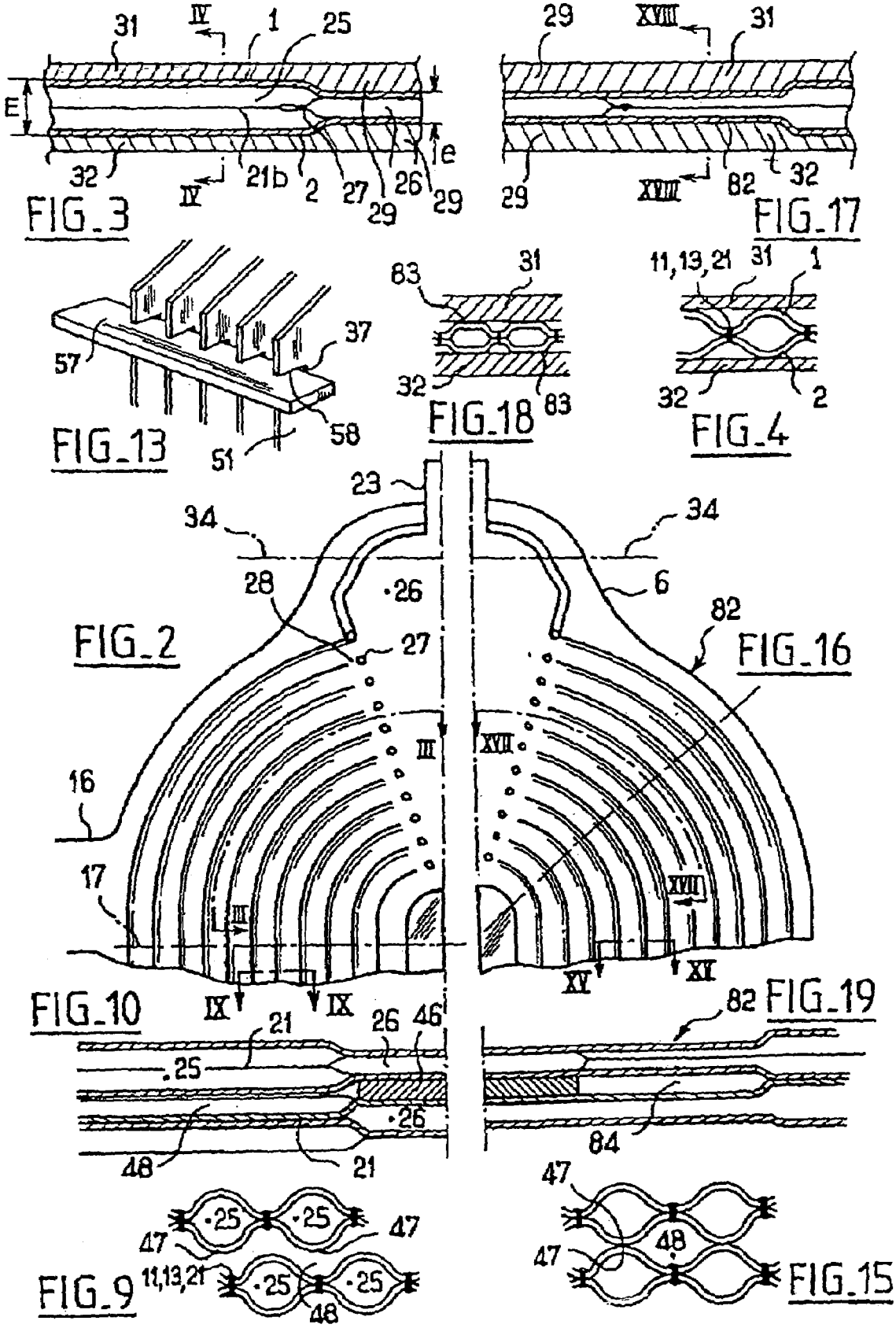
FIG. 2 is a plan half-view of a part of the module shown in FIG. 1.
FIG. 3 is a cross-sectional view through III—III of FIG. 2, during the hydroforming.
FIG. 4 is a cross-sectional view through IV—IV of FIG. 3.
FIGS. 9 and 10 are cross-sectional views through IX-1× and III—III respectively of FIG. 2, after the stacking of the modules.
FIG. 13 is a partial perspective view illustrating the suspension of the core.
Figure 11:
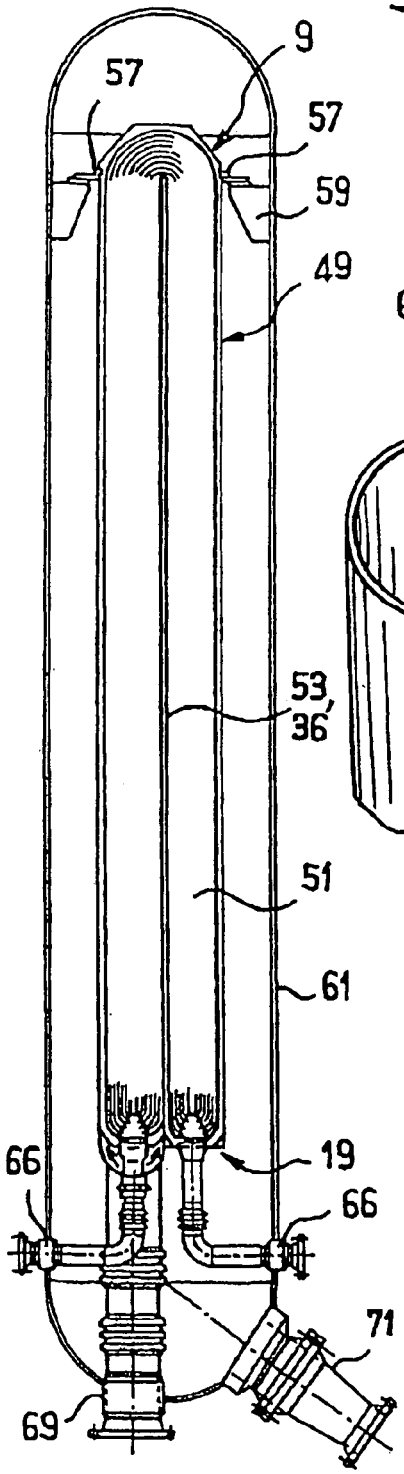
FIG. 11 is a longitudinal cross-sectional view of the exchanger in an operating position.
Figure 12:
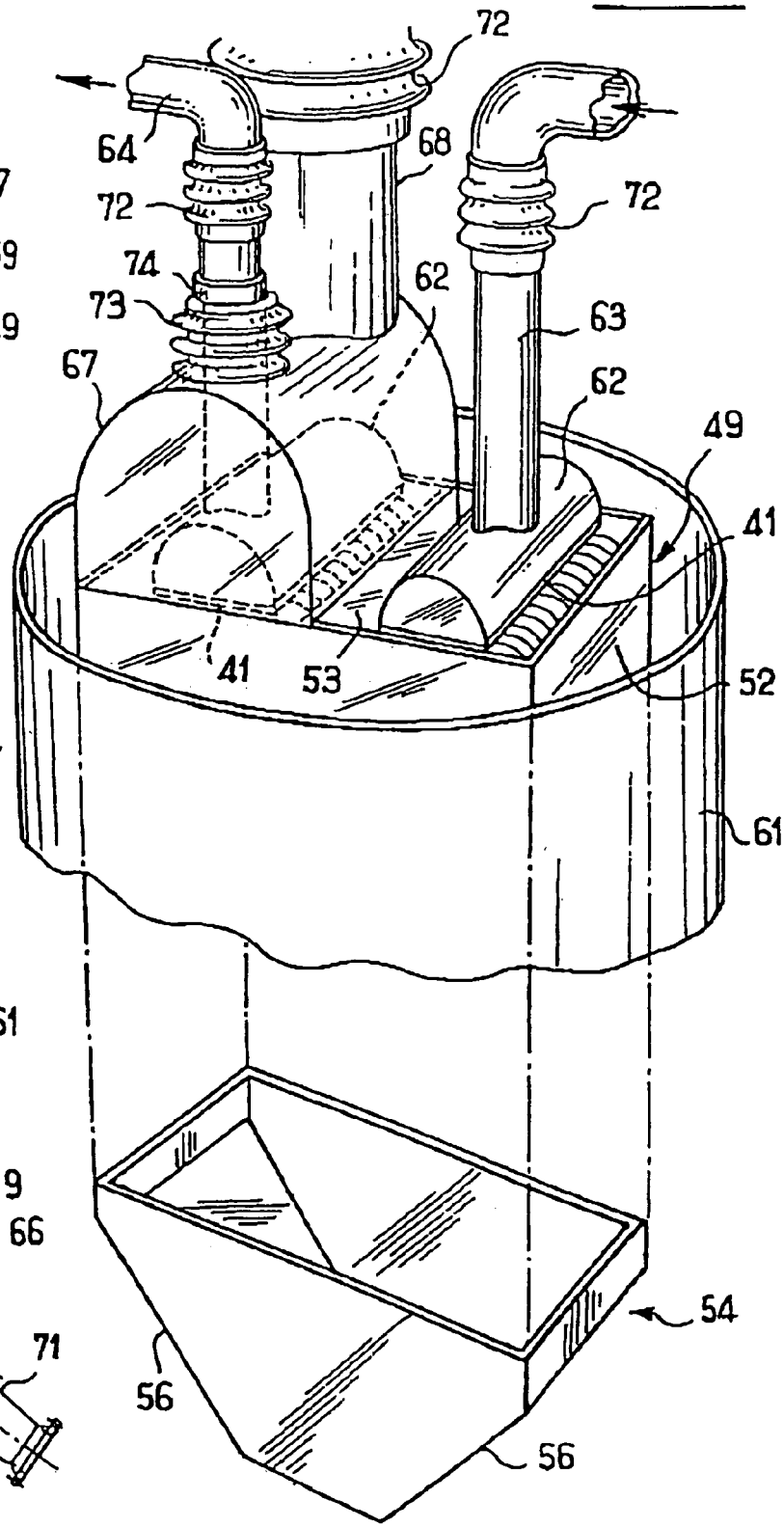
FIG. 12 is an exploded perspective view, with tear-aways, showing the exchanger in an inverted position for greater clarity.
Figure 22:
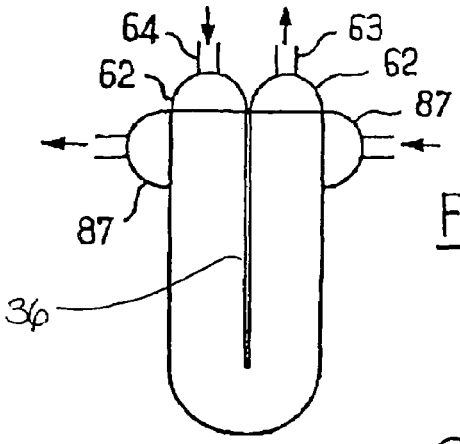
Figure 20:
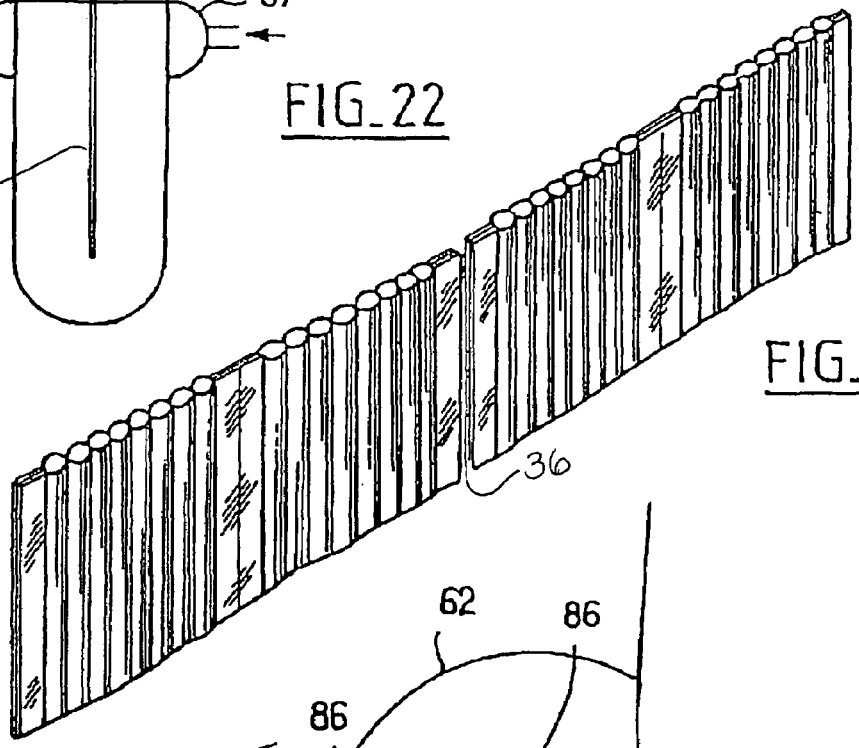
Figure 23:
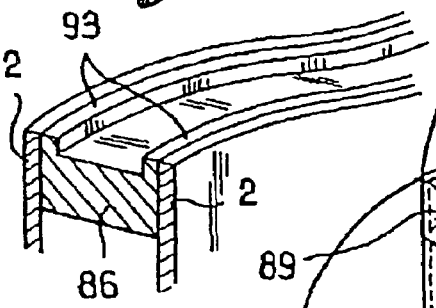
Figure 21:
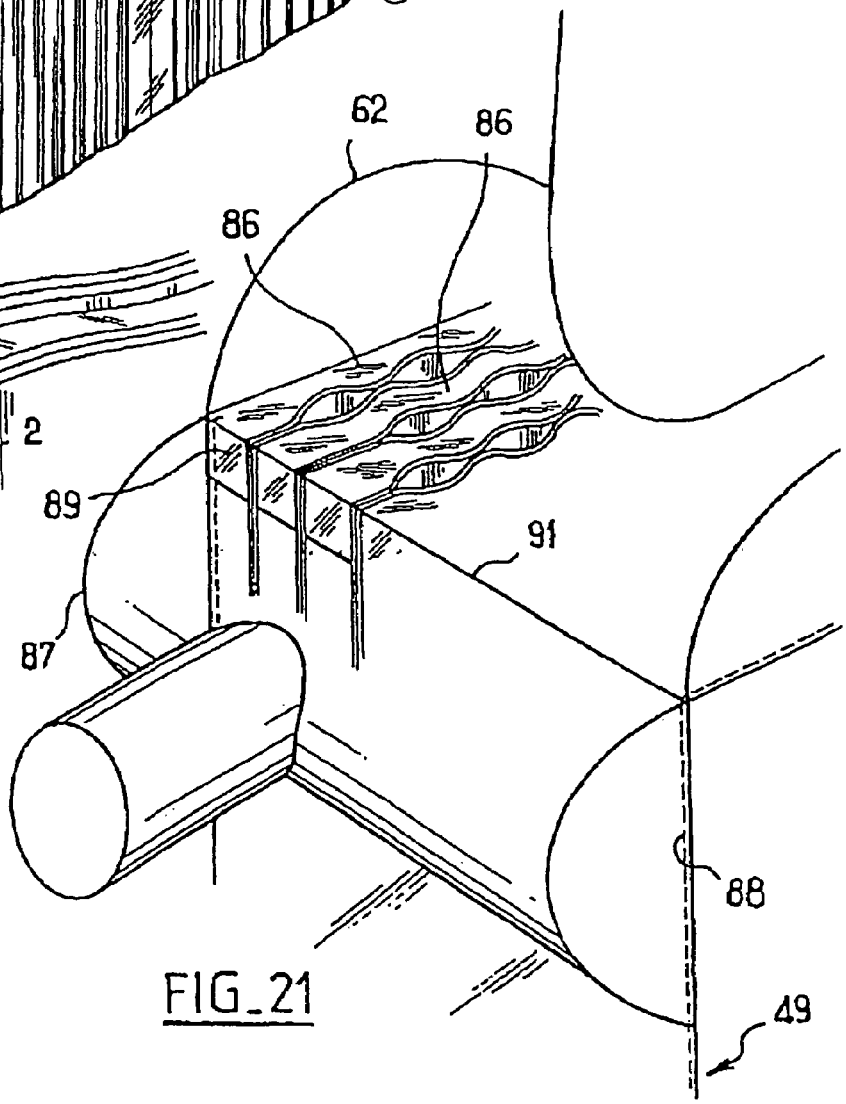
Figure 24:
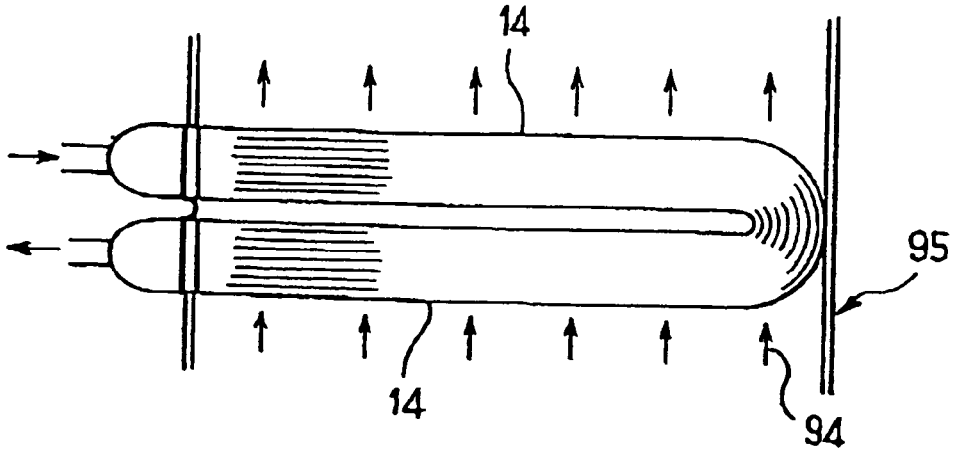

FIG. 15 as a cross-sectional view through XV—XV of FIG. 16;

FIG. 16 is a view similar to that of FIG. 2 but relating to a second embodiment;

FIG. 17 is a view analogous to that of FIG. 3 but taken through XVII—XVII of FIG. 16;

FIG. 18 is a cross-sectional view through XVIII—XVIII of FIG. 17;

FIG. 19 is a cross-sectional view through XVII—XVII of FIG. 16 after the stacking of the modules;

FIG. 20 is a partial perspective view showing a third embodiment of a module in the vicinity of the connection orifice;

FIG. 21 is a partial perspective view of the connection means of a core equipped with modules according to FIG. 20;

FIG. 22 is a general diagram of the exchanger equipped with such a core;

FIG. 23 is a perspective view illustrating a variant for the bars shown in FIG. 21;

FIG. 24 is a general view of a variant installation of the exchanger; and

Figure 25:
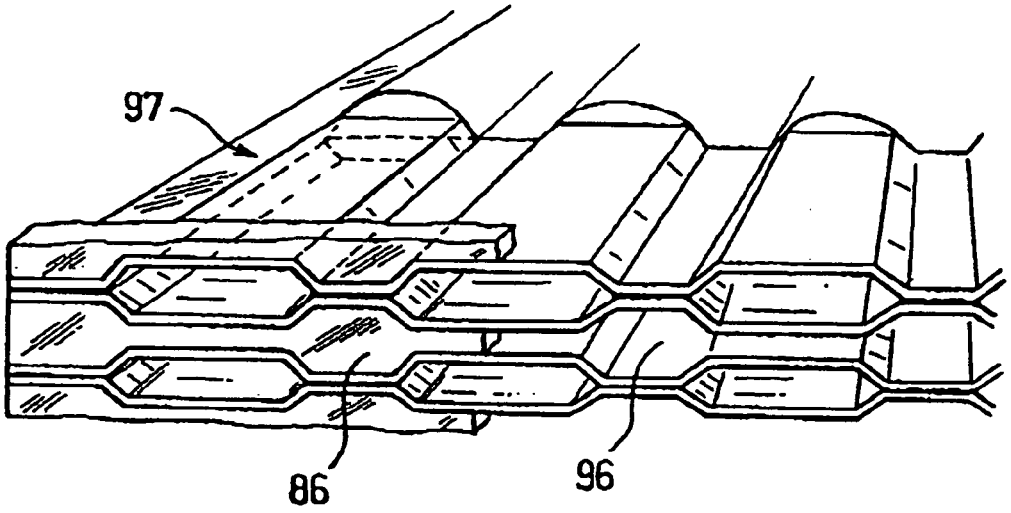

FIG. 25 is a perspective view illustrating a variant of FIG. 21.

DETAILED DESCRIPTION OF THE INVENTION

In the examples shown in FIGS. 1 to 14, a heat exchange module 1 (FIG. 1) is obtained by laser welding two initially flat metal sheets 2, cut out with an identical contour. The contour of the metal sheets 2 has a very generally rectangular shape whose length corresponds to the vertical direction of FIG. 1. At a rear end 9 of this length, each corner of the contour of the metal sheets 2 has a chamfer 3. At the other end 19 of its length, or "Module head", the contour forms two domes 4 of generally semicircular shape disposed side by side, each extended by a protrusion 6 of generally trapezoidal shape, whose peak 7 corresponds to the small base of the trapezium.

The width of the metal sheets 2 can for example range between 100 and 1600 mm. The length of the metal sheets is limited only by the dimension of the means available for limiting the expansion in thickness during the hydroforming operation which will be described below. In practice, metal sheets of 10 meters and more in length are possible. However, because of the progress in compactness made possible by the invention as explained above, metal sheets having a length of 8 meters for example already allow considerable exchange performance in terms of transferred heat energy.

The thickness of the metal sheets can range between 0.2 and 1.5 mm. It is therefore very small for economic and thermal reasons.

The two metal sheets 2 are welded one against the other in such a way that their contours coincide. The welding is carried out by laser. This known technique makes it possible to weld the metal sheets to each other at a distance from their edges by means of a beam passing through the metal sheets and causing their localised fusion within their mass and the reciprocal interpenetration of the metal constituting the two metal sheets.

The two metal sheets are thus joined to each other by a peripheral weld seam 8 which generally follows the outer contour of the two metal sheets at a distance of a few centimeters within the contour. The peripheral weld seam 8 thus forms a continuous outer U-shape including two longitudinal sections 13*a* which are parallel with each other, each one running along the respective one of the longitudinal edges 14 of the contour of the metal sheets, and a semi-circular seam 11*a* which runs along the contour of the rear end 9 of the module and joins the two longitudinal sections 13*a*.

Between the two domes 4, the contour of the metal sheets forms a recess having a bottom 16 located for example a little way before a line 17 parallel with the width of the metal sheets 2 and passing through geometric centres 18 of the domes 4. In this zone, the peripheral seam 8 is locally distanced from the outer contour of the metal sheets and more particularly forms a continuous inner U-shape including two inner longitudinal seams 13*g* parallel with each other and with the outer longitudinal seams 13*a*, and an inner semicircular seam 11*g*. The seam 11*g* has the same centre 12 as the outer semicircular seam 11*a* and connects the two inner longitudinal seams 13*g*. At the head 19 of the module, each outer longitudinal seam 13*a* and the closest inner longitudinal seam 13*g* are joined to each other by an arch-shaped seam including two circular segments belonging to a same circle centred on the geometric centre 18, one of them 21*a* extending the outer longitudinal seam 13*a* and another one 21*g* extending the inner longitudinal seam 13*g*. The two segments 21*a* and 21*g* of each dome 4 are connected to each other by a connecting seam 22 approximately following the contour of the boss 6. However, one of the connecting seams 22 is interrupted at its centre at a location where a tubular nozzle 23 is inserted between the two metal sheets 2 to allow the injection of a hydroforming fluid from the outside of the module into the space located between the two metal sheets and surrounded by the peripheral seam 8. Apart from the passage constituted by the nozzle 23, the peripheral seam 8 closes in a fluid-tight manner the space that it surrounds between the two metal sheets 2.

Between each outer longitudinal seam 13*a* and the closest inner longitudinal seam 13*g*, there is a series of longitudinal, parallel and equidistant seams each extending between the diametral line 17 and the diametral line 24 passing through the centre 12 perpendicularly with respect to the seams 13*a* and 13*g*. In the example shown, there is an odd number of longitudinal seams on each side of the central axis A. A central longitudinal seam 13*d* extends along a secondary longitudinal axis B located in an equidistant manner between the outer longitudinal seam 13*a* and the closest inner longitudinal seam 13*g*.

Intermediate outer longitudinal seams 13*b* are located between the seam 13*a* and the axis B. Intermediate inner longitudinal seams 13*f* are located between the axis B and the inner longitudinal seam 13*g*. The references 13*c* and 13*e* are given to the intermediate longitudinal seams adjacent to the central seam 13*d* and located on the side of the outer seam 13*a* and on the side of the inner seam 13*g* respectively.

At the rear end 9 of the module, each intermediate longitudinal seam 13*b*, 13*c*, 13*e*, 13*f*, or central seam 13*d* is connected to the symmetrical longitudinal seam with respect to the central axis A of the module by a semicircular seam 11*b*, 11*c*, 11*e*, 11*f* or 11*d* respectively that are concentric with the inner 11*a* and outer 11*g* semicircular seams already described.

Between the outer U-shape 13*a*, 11*a*, 13*a* and the inner U-shape 13*g*, 11*g*, 13*g* already described, there are therefore formed several continuous U-shaped seams defining between them a group of channels 25 having a U-shape configuration. The channels 25 have a width, or "channel succession pitch", which is the same for all of the channels and which is constant along all of the channels.

At the head 19 of the module, the intermediate longitudinal weld seams 13*b* and 13*f* are extended by seams shaped like segments of circle 21*b* and 21*f* respectively which are centred at 18 and which end along a lateral edge of a distribution chamber 26 which is on the other hand delimited by the weld seam 22 already described. In this way, the channels 25 defined between the weld seams have at each end of the U-shape a region 21*ac* or 21*cg* converging towards a distribution chamber 26 with which they are connected. The regions 21*ac*, contained between the outer seam 21*a* and the intermediate seam 21*c*, incurve towards the central axis B of the leg of the U-shape and towards the axis A of the module. The regions 21*cg*, contained between the seams 21*c* and 21*g*, incurve towards the axis B coming from the other side of the latter while diverging from the axis A. The regions 21*ac* emerge perpendicularly through a side of the distribution chamber 26 and the regions 21*cg* emerge perpendicularly through another side of the distribution chamber 26. The channels 25 preserve, even in the convergent region 21*ac* or 21*cg*, a width, or "channel succession pitch", that is unchanged with respect to the rest of the channels. Each convergent region 21*ac* follows a path substantially located in the curved extension of the convergent region 21*cg* of another channel 25 located symmetrically with respect to the axis B in the group of channels. Similarly, each curved seam 21*b* is in the curved extension of a seam 21*f*, the distribution chamber 26 forming an interruption between these two seams. On the other hand, the two longitudinal weld seams 13*c* and 13*e* located immediately on either side of the central seam 13*d* are connected to each other in a continuous manner by a semicircular seam 21*c* centred at 18, and the central seam 13*d* is terminated at 18 by a stop or "spot weld" intended to increase the mechanical strength of the end of the seam. Again for reasons of the mechanical strength of the welding, each seam shaped like a segment of circle 21*b* or 21*f* terminates with a "spot weld" 27 preceded by an interruption 28—see FIG. 2 also. Such a spot can in practice be constituted by a circular or ovoid seam of small diameter.

For the hydroforming, the two metal sheets 2 are placed whilst still flat between two dies 31 and 32 (FIG. 3) of generally flat shape with a free distance E between them corresponding to the desired outer thickness of the modules in the region of the channels. In the region intended to correspond with the distribution chamber 26 of the module, the inner face of the dies 31 and 32 has a boss 29 intended to bring the free distance between them down to a value "e" that is smaller for the distribution chamber 26 than for the region of the channels 25.

The hydroforming operation consists in injecting a liquid such as water under pressure between the two metal sheets 2 through the nozzle 23. The water trapped between the two metal sheets inside the contour of the peripheral seam 8 produces an inflation between the weld seams and in the zone of the distribution chamber and this occurs within the limit permitted by the dies 31 and 32. In this way there is formed on the one hand the described channels 25 and on the other hand, at each end of the U-shape of the configuration of the group of channels, the distribution chamber 26. The two chambers 26 connect with each other through each of the U-shape channels defined between two adjacent weld seams, which are thus in parallel, from the fluidic point of view, between the distribution chambers 26. FIG. 4 shows in a cross-section of the channels how the latter are formed between the dies 31 and 32 and between the weld seams 11, 13 or 21.

The regions of metal sheet located outside of the peripheral seam 8 and between the two longitudinal seams 13*c* and 13*e* and between the two corresponding semicircular seams 11*c* and 11*e* are not subjected to the pressure and do not therefore undergo any inflation. They therefore remain flat and adjacent to each other. These outer 33*a*, intermediate 33*d* and inner 33*g* zones constitute stiffeners which have proved beneficial for the correct flatness of the module after the hydroforming.

Figure 1:
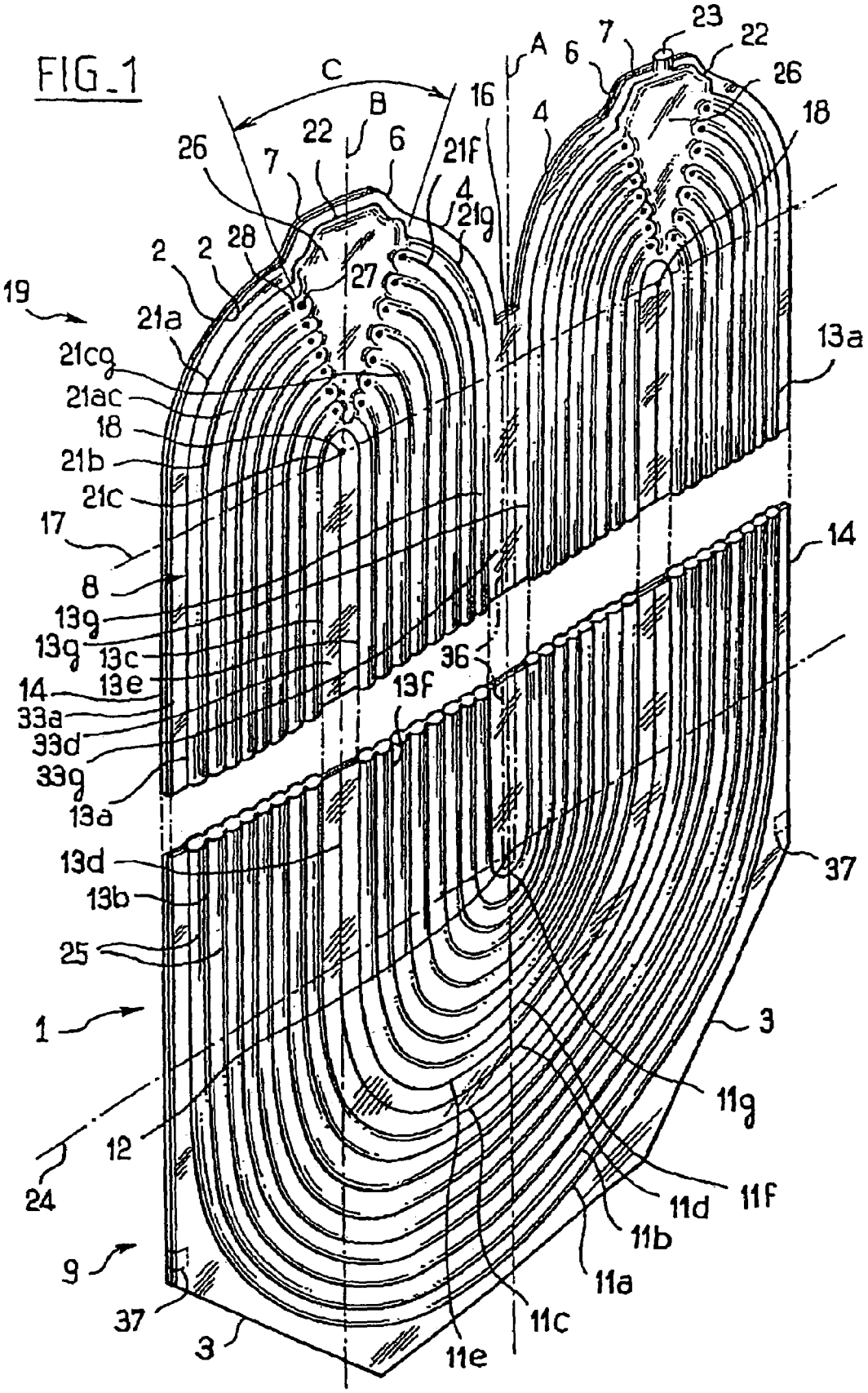
FIG. 1 is a perspective view of a module according to the invention, with a central tear-away, at an intermediate stage of manufacture.

In order to progress from the blank shown in FIG. 1, resulting from the hydroforming, to an actual module ready for assembly in order to constitute an exchange core, the top of each boss 6 is cut off with a saw or a water jet as shown in FIG. 2 along a line 34 in order to open each distribution chamber 26 and to eliminate the nozzle 23. The module thus has two connection orifices 38 (FIGS. 5 and 6) both situated at the head 19 of the module and offset laterally with respect to one another, that is to say in a direction parallel with the width of the module. Each distribution chamber 26 has the general shape of an isosceles triangle, symmetrical with respect to the axis B. The connection orifice 38 is formed through the base of this triangle. The two sides of the triangle are each defined by the alignment of the ends of the convergent regions 21*ac* or 2*cg* respectively of the channels 25 and together form on the axis B an angle C of less than 60°, preferably equal to about 45°, opposite the connection orifice 38. Weld seams 22*a*, 22*g* (FIG. 5), which remain of the initial seam 22, each extend around a part of the periphery of the distribution chamber 26 between the respective one of the extreme curved weld seams 21*a*, 21*g* and a corresponding end of the connection orifice 38, which is of elongated shape. The weld seam 21*c* hermetically connecting the two longitudinal seams 13*c* and 13*e* closes the distribution chamber 26 at its top forming the angle C. Inside the contour of each chamber 26, the two metal sheets 2 are free of mutual connection, and in particular of any welded connection.

Furthermore, as illustrated in dotted and dashed lines in FIG. 1, there is formed by cutting out in the inner flat zone 33*g* located inside the inner U-shape 11*g*, 13*g*, a slot 36 along the main axis A starting from the bottom 16 of the recess between the two domes 4 and ending at about the centre 12 of the bend of the U-shape channels at the rear end 9 of the module.

Furthermore, two notches of generally rectangular shape 37 are formed in the metal sheets 2, in the longitudinal edges 14 in the vicinity of the chamfers 3.

FIGS. 5 and 6 show the assembly of modules to form a core. At each end of the U-shape of the configuration of the channels of each module, the connection orifice 38 formed by the cutting 34 of the boss 6 fits into openings of corresponding shape 39 provided in an end plate 41 common to all the modules of the core to be produced. Measured parallel with the width of the modules, a dimension 42 of the plate 41 is smaller than a width 43 of each U-shape arm of a module measured between one of the longitudinal edges 14 and the central axis A. The connection orifices 38 are welded into the openings 39 in such a way as to secure the modules in a relative stacking position. The geometry of the stack is also defined by spacing means that can include blocks 44 (FIG. 7) welded against the flat outer and inner zones 33*a*, 33*g* of the modules, or against the flat intermediate zone 33*d*. These blocks prevent the modules from moving with respect to each other in particular transversely with respect to their own planes. Triangular blocks 46 are also used, which are interposed between the adjacent distribution chambers 26 to prevent, in service, the inflation of the distribution chambers 26 under the effect of the pressure existing inside the modules in service, which in most applications is higher than that of the exchange fluid which flows between the modules.

FIG. 8 illustrates that for the example shown, two types of modules 101, 102 are used which alternate in the stack and which differ by an off-set of the channels, the off-set being one half channel succession pitch. Thus, in particular the inner longitudinal seams 13*g* of the modules 101 are closer, by one half channel succession pitch, to the axis A than are the seams 13*g* of the modules 102 and the radius of the semicircular seams 11*g* of the modules 101 is smaller, by one half channel succession pitch, than that of the seams 11*g* of the modules 102. Thus, more generally, the channels 25 have an overall staggered arrangement which is again illustrated in FIG. 9, undulation peaks 47 of the outer face of a module facing the undulation troughs corresponding to the weld seams 11, 13 or 21 of an adjacent module. With this configuration, a path 48 provided for the second exchange fluid between each pair of adjacent modules has the form of a continuous undulating gap. The inlet or the outlet of the second fluid between the modules takes place at each end of the U-shape, respectively, between the zones 21*ac* and 21*cg* of the channels 25, on either side of the triangular blocks 46, and without restriction of cross-section because of the half-pitch offset. FIG. 10 shows in a cross-section though III—III of FIG. 2 the stacking of two modules in the zone of the distribution chambers 26 and of the start of certain channels 25.

FIG. 8 illustrates that for the example shown, two types of modules 101, 102 are used which alternate in the stack and which differ by an off-set of the channels, the off-set being one half channel succession pitch. Thus, in particular the inner longitudinal seams 13*g* of the modules 101 are closer, by one half channel succession pitch, to the axis A than are the seams 13*g* of the modules 102 and the radius of the semicircular seams 11*g* of the modules 101 is smaller, by one half channel succession pitch, than that of the seams 11*g* of the modules 102.

Once the stack of modules is constituted, the latter is inserted in a cover 49 (FIGS. 11 and 12) whose longitudinal direction corresponds to that of the modules 1. A peripheral wall 52 of the cover 49 has a rectangular inner profile corresponding with the outer transverse profile of the stack of modules 1, as closely as possible in view of the manufacturing tolerances. The cover 49 furthermore includes along one of the medians of its rectangular profile a median partition 53 intended to be inserted, also as closely as possible, in the slot 36 of the modules.

At the rear end of the cover 49, which corresponds to the rear end 9 of the modules, the cover 49 is closed by an end-cover 54 having chamfers 56 intended to come substantially into contact with the chamfers 3 of the modules. In general, in order to place the core in the cover, the core is slipped in through the rear of the cover until the bottom of the slot 36 of the modules abuts the rear edge of the central partition 53 of the cover, then the cover 49 is closed using the end-cover 54.

In service (FIG. 11) the rear end 9 of the modules and the end-cover 54 of the cover are placed in the high position.

At the top of the peripheral wall 52 there are fixed by welding two opposed bars 57 (see also FIG. 13) which protrude towards the inside of the cover and are engaged in the notches 37 of the modules. The core is thus suspended by the bearing of the shoulders 58 forming the upper edge of the notches 37 against the upper face of the bars 57. The bars 57 also protrude to the outside of the cover 49 in order to rest on brackets 59 fixed against the inner face of a cylindrical enclosure 61 housing the core, the cover 49 and the means of connecting the core which will be described.

As the rear end 9 of the modules is placed in the high position, their heads 19 and with them the connection means remaining to be described are grouped in the low position in the lower end of the enclosure 61. For the first exchange fluid, intended to flow inside the modules, the connection means include two connecting boxes 62 (FIG. 12) of generally semi-cylindrical shape. Each box 62 is welded in a fluid-tight manner by its open rectangular periphery to the periphery of the respective one of the plates 41 in order to connect all of the connection orifices 38 located on a same side of the axis A with a connecting pipe 63 for the inlet of the first fluid, and in order to connect all the orifices 38 located on the other side of the axis A with a connecting pipe 64 for the outlet of the first fluid. Each pipe 63, 64 opens into the respective connecting box 62 and reaches the exterior through a fluid-tight passage 66 in the enclosure 61 (FIG. 11) in order to form part of a first external circuit, for the first exchange fluid.

Each connecting box 62 has a generally semi-cylindrical shape with respect to which the corresponding plate 41 extends substantially in an axial plane.

An external connecting box 67, bigger than the boxes 62, is mounted in such a way as to enclose one of the boxes 62. The box 67 is fixed to the upper edge of one of the two longitudinal compartments defined in the cover 49 by the median partition 53 and one of the halves of the rectangular profile of the peripheral wall 52. The box 67 connects this compartment in a fluid-tight manner with a connecting pipe 68 which opens into the box 67 for the inlet of the second fluid into this compartment of the cover by passing on either side of the connecting box 62 which is surrounded by the box 67. The pipe 68 extends to the outside of the enclosure 61 by passing through a fluid-tight passage 69 and thus forms part of a second external circuit, for the second exchange fluid. The other compartment defined in the cover 49 by the partition 53 is freely open in the enclosure 61 which serves as a return collector for the second fluid. The enclosure 61 is connected with the exterior for this purpose by a connector 71 which is also part of the second external circuit. Each connecting pipe 63, 64, 68 is equipped with a respective expansion compensator 72 in order to absorb the dimensional variations between the head 19 of the core and the corresponding fluid-tight passage 66 or 69 of the enclosure. The connecting pipe 64 passes through the connecting box 67 in a fluid-tight manner with the interposition of an expansion compensator 73 between the connecting box 67 and a fluid-tight collar 74 fixed around the pipe 64. All of the expansion compensators are fitted in order to compensate for the dimensional variations in the longitudinal direction of the modules. The two ends of the U-shape configuration of the modules are rendered mechanically independent from each other for longitudinal displacements because, in service, the hot end into which penetrates the fluid intended to release calories and from which emerges the fluid having received the calories must be able to expand much more than the cold end.

In operation, the first exchange fluid penetrates into one of the distribution chambers 26 of each module, through one of the connecting boxes 62, passes through the U-shape channels disposed, from the fluidic point of view, in parallel, collects in the other distribution chamber 26 and leaves the core through the other connecting box 62. The connecting chambers 26 have a triangular shape such that their cross-section decreases starting from the connection orifice 38 and as it progresses towards the most central channels. The effect of this is that the fluid is distributed more or less evenly between the channels 25 and that the flow speed of the fluid is more or less the same all along a module, from one connection orifice to the other. The second exchange fluid penetrates into one of the compartments of the cover by passing-through the connecting box 67 on either side of the corresponding connecting box 62 and is distributed in every gap between adjacent modules, because of the continuity of the said gap 48 (FIGS. 8 and 9). The second exchange fluid must pass round the rear end of the partition 53, and must consequently travel, in counter-flow with respect to the first fluid, along the whole of the overall length of the channels of the modules. The blocks 44 (FIG. 7) prevent the second exchange fluid from preferably choosing the thermally inefficient path extending between the flat zones 33*a*, 33*d*, 33*g* of the adjacent modules. This effect of braking the flow along the flat zones can be increased by various elements forming a chicane, such as for example sinusoidally shaped springs 76 interposed with a certain stress between the flat zones 33*a*, 33*d* and 33*g* of the modules (FIG. 7) or even combs 77 (FIG. 14) fixed against the inner faces of the cover adjacent to the lateral sides of the modules. Such combs advantageously comprise a metal sheet forming an attachment base, in which punctures 78 are formed by cutting out and stamping forming protrusions 79. Slits 81 defined between the protrusions 79 receive and guide the flat outer 33*a* or inner 33*g* parts of the modules. These springs 76 and combs 77 serve at the same time to immobilise the modules with respect to displacements in the transverse direction with respect to their own plane.

The example shown in FIGS. 15 to 19 will be described only where it differs with respect to the preceding one. In this embodiment, the modules are all identical and, in the stack, the peaks 47 of the undulations of the outer faces of the adjacent modules are in contact or virtually in mutual contact. The path for the second exchange fluid is therefore itself also constituted by channels that are almost completely separated from each other. In order that the second exchange fluid may feed these channels 48, arrangements are made during the hydroforming such that a region 82 (FIG. 16) of the channels, adjacent to the distribution chamber 26 on either side of the latter, has a reduced thickness, for example equal to the thickness e of the distribution chamber 26. It suffices for this purpose for the boss 29 of the dies 31 and 32 to have a correspondingly greater extent than in the preceding embodiment. Flattened channels 83 shown in FIG. 18 are obtained in this region. Thus, in the region 82, the passages 48 are connected to each other by interconnections 84 (FIG. 19) and form with them a distribution chamber for the second exchange fluid.

In the example shown in FIGS. 20 to 22, which will be described only where it differs with respect to that of FIGS. 1 to 14, modules without a distribution chamber are formed simply by cutting off the blank 1 of FIG. 1 along the line 17. The whole region of the domes 4 has been used only for the hydroforming before being eliminated. At each end of the U-shape configuration, the connection orifice of the module is therefore formed by the open ends of the longitudinal channels.

The modules are assembled by welding, between their connection orifices, shaped bars 86 which together constitute a base onto which the connecting box 62 will be welded. The latter is of larger size than in FIG. 12 and completely closes the corresponding compartment of the cover 49. Connecting boxes 87 for the second exchange fluid are fixed in such a way as to obturate a rectangular indentation 88 formed at the top of the cover 49 in each of the two walls of the cover parallel with the partition 53. Ends 89 of the bars 86 form with the edges of the modules interposed between them a continuous surface against which a corresponding edge 91 of the connecting box 87 can be welded in a fluid-tight manner. Two connecting boxes 87 have been shown in FIG. 22 but one of them can be omitted if the enclosure 61 is used as a collector as was described with reference to FIG. 12.

FIG. 23 shows a variant for the bars 86 with a welding lip 93 along the edge of each adjacent metal sheet 2. In a way which is not shown, the bars 86 must also have at each end a transverse lip for the fluid-tight welding of the edge of the connecting box 62.

FIG. 24 shows a so-called cross-current embodiment, according to which the core of modules is mounted in a cover 95 which is open over the whole surface adjacent to the outer longitudinal edges 14 of the modules, on either side of the core. In this case there is no partition separating the two legs of the U-shape, and it is therefore no longer necessary to form the slot 36 between the two legs of the U-shape. Due to the invention, even in this version, certain advantages are however obtained if the direction of flow 94 of the second fluid is such that it passes firstly between the legs of the U-shape located downstream with respect to the direction of flow of the first fluid, as shown. This embodiment necessitates that the gap 48 reserved between the modules for the path of the second fluid should be continuous, for example as shown in FIG. 9.

The embodiment shown in FIG. 25 will be described only where it differs with respect to that of FIGS. 20 to 22. In a certain region 97 adjacent to their open ends forming a connection orifice, the modules have been given during their hydroforming a reduced thickness in order to form in this zone a distribution chamber 96 for the second exchange fluid. The modules are all identical and the undulations of the adjacent modules are in peak-to-peak contact except in the region of reduced thickness 97. The profile of the bars 86 is adapted in a corresponding manner.

The invention is not of course limited to the examples described and shown.

The exchanger could be designed to exchange heat between more than two fluids. The zone of the bend of the U-shape could be configured differently. It is not necessary to have a flat zone in the median region of the group of channels.

The embodiment shown in FIGS. 1 to 14 relates more particularly to the case in which the first exchange fluid is essentially liquid whilst the second exchange fluid is at least partially gaseous, therefore necessitating larger passage cross-sections, but this is not a necessity.

The invention is applicable to exchangers where the two fluids flow in the same direction along their respective paths.

In the embodiment shown in FIGS. 20 to 23 and 25, the head structure of the modules before the cutting, intended to reveal the two connection orifices of each module, serves only for the use of hydroforming. It has no hydrodynamic function and its requirements of resistance to temperature and pressure can be lower. It can consequently be simplified, in particular in order to facilitate its manufacture and to save sheet metal.

The channels of a same module could be given different widths from one channel to the other.

In the embodiments shown, the channels 25 emerge through straight sides of the distribution chambers 26. However, these sides could also be curved, concave or convex, for example but not limitatively in the shape of a segment of circle.

The invention claimed is:

1. A heat exchange module, adapted to be part of a stack of such modules in a heat exchanger, said module comprising two metal sheets welded along weld lines defining between said metal sheets a group of channels disposed side by side substantially in a common plane, at least one said channel extending between two other said channels of the group, said channels being adapted to be passed through by an exchange fluid and, from the fluidic point of view, being in parallel with each other between at least two connection orifices of said module that are laterally separated from each other, said group of channels having a generally U-shaped configuration, wherein each channel connects said connection orifices together independently of the other said channels and wherein said two metal sheets further define between them at least one distribution chamber intercommunicating a corresponding end of said channels with a respective one of said connection orifices of said module; and wherein each of said channels essentially has a continuous cross-sectional area and a constant width between two side edges, each said side edge extending along a respective path defined by a respective weld line comprising two linear segments connected to each other by an arcuate segment.

2. The heat exchange module according to claim 1, wherein said at least two connection orifices are disposed side by side at a same end of said module.

3. The heat exchange module according to claim 1, wherein said weld lines are seams that extend along a continuous U-shaped path.

4. The heat exchange module according to claim 3, wherein said seams form concentric arcs of a circle in a bend of said U-shaped configuration.

5. The heat exchange module according to claim 1, wherein said U-shaped configuration of said group of channels further comprises at least two legs that are separated by a zone without channels.

6. The heat exchange module according to claim 5, wherein said zone without channels comprises welded flat parts of said metal sheets.

7. The heat exchange module according to claim 5, wherein said zone without channels comprises a slot formed in said two metal sheets between said two legs of said U-shaped configuration of the channels, starting from one edge of each metal sheet located between the two ends of said U-shaped configuration.

8. The heat exchange module according to claim 1, further comprising a stiffening zone constituted by mutually adjacent flat regions of said two metal sheets between certain channels, and/or along the outer periphery of said U-shaped configuration.

9. The heat exchange module according to claim 1, wherein said channels have adjacent said corresponding end, a curved region which converges from a longitudinal region towards the distribution chamber.

10. The heat exchange module according to claim 9, wherein said distribution chamber is substantially symmetrical with respect to a longitudinal axis of said group of channels, said convergent regions of said channels incurving in a same respective direction on each side of said axis.

11. The heat exchange module according to claim 9, wherein said convergent regions follow a path shaped like a segment of a circle, preferably having the same center.

12. The heat exchange module according to claim 9, wherein a succession pitch of said channels remains substantially constant along said convergent regions and is substantially the same as across said longitudinal regions of said channels.

13. The heat exchange module according to claim 9, wherein said curved region of each of said channels follows a path substantially situated in a curved extension of said convergent region of said channel disposed symmetrically in said group of said channels.

14. The heat exchange module according to claim 1, wherein at the ends of said channels, continuous weld seams separating the adjacent channels are followed by a spot weld a small distance beyond each of said seams.

15. The heat exchange module according to claim 1, wherein said distribution chamber has no welded connection between said two metal sheets inside a contour of said distribution chamber.

16. The heat exchange module according to claim 1, wherein said distribution chamber has a generally triangular shape with an apex on the longitudinal axis of said group of channels, whose angle is about equal to 45°, opposite said connection orifice passing through a base of said chamber.

17. The heat exchange module according to claim 9, wherein said curved regions of said channels emerge through two sides of said distribution chamber which converge towards each other in a direction going from said connection orifice towards an end of said chamber opposite said connection orifice.

18. The heat exchange module according to claim 9, wherein said curved regions of said channels emerge approximately perpendicularly through two sides of said distribution chamber.

19. The heat exchange module according to claim 1, wherein said module comprises two weld seams each extending around a part of the periphery of said distribution chamber between a respective extreme weld seam of said group of channels and a respective end of said connection orifice.

20. The heat exchange module according to claim 1, wherein said distribution chamber is closed by a weld seam at its end opposite to the connection orifice, said weld seam connecting to each other two of said weld lines bordering an intermediate zone without channels between two central channels of said group of channels.

21. The heat exchange module according to claim 1, wherein said distribution chamber has a dimension smaller than that of the channels in the direction of the thickness of the module.

22. The heat exchange module according to claim 1, wherein there is a connection orifice, a distribution chamber and a convergent region of said channels at each one of the two ends of said group of channels.

23. A heat exchanger comprising:

a stack of heat exchange modules, installed in a cover in such a way that ends of a U-shaped configuration in each module are directed on a same side of the stack, these modules defining, between them and inside the cover, passages for a second exchange fluid;

first connection means for connecting two connection orifices of each module with a first external circuit;

second connection means for connecting said passages with a second external circuit, wherein each heat exchange module comprises two metal sheets welded along weld lines defining between said metal sheets a group of channels disposed side by side substantially in a common plane, at least one said channel extending between two other said channels of the group, adapted to be passed through by an exchange fluid and, from the fluidic point of view, being in parallel with each other between said two connection orifices that are laterally separated from each other, said group of channels having a generally U-shaped configuration, wherein each channel connects said connection orifices together independently of the other said channels; and wherein each said channel essentially has a continuous cross-sectional area and a constant width between two side edges, each said side edge extending along a respective path defined by a respective weld line comprising two linear segments connected to each other by an arcuate segment.

24. The heat exchanger according to claim 23, wherein the peaks of the undulations of the outer adjacent faces of neighboring modules are mutually facing each other.

25. The heat exchanger according to claim 23, wherein in each pair of mutually facing outer faces of neighboring modules, undulation peaks of each face of the pair are substantially facing undulation troughs of the other face of the pair.

26. The heat exchanger according to claim 25, further comprising two types of said modules which differ by an offset of a half-pitch of the longitudinal regions of the channels with respect to the central axis of said U-shaped configuration, wherein the modules of one type alternate with the modules of the other type in the stack of modules.

27. The heat exchanger according to claim 23, wherein said cover contains means of positioning the modules with respect to displacements perpendicular to the plane of the modules.

28. The heat exchanger according to claim 23, wherein said first connection means comprise a connecting box comprising:

a base through which the orifices of the modules emerge in a fluid tight manner; and a body to which is connected a pipe for connection with the first external circuit.

29. The heat exchanger according to claim 28, wherein said second connection means comprise a second connecting box which:

is connected to the cover;

encloses the box of the first connection means;

is passed through in a fluid tight manner by the connecting pipe of the first connection means;

and to which a second connecting pipe is connected in a fluid tight manner.

30. The heat exchanger according to claim 23, wherein said second connection means connects the second external circuit with distribution zones extending at least partly between zones of reduced thickness of the channels.

31. The heat exchanger according to claim 23, wherein said first and second connection means are gathered at one end of the exchanger corresponding to the two ends of said U-shaped configuration.

32. The heat exchanger according to claim 23, wherein said first connection means are disposed at a same end of the exchanger, whilst said first connection means has two parts which are respectively connected to the two ends of the U-shaped configuration and which are separated from each other in such a way as to ensure thermal decoupling.

33. The heat exchanger according to claim 31, wherein said end is a lower end.

34. The heat exchanger according to claim 23, further comprising a recess separating the two longitudinal legs of said U-shaped configuration of the channels of the modules, wherein said recess mechanically disconnects both ends of said U-shaped configuration.

35. The heat exchanger according to claim 34, wherein said cover comprises a partition extending across the recesses of the modules.

36. The heat exchanger according to claim 34, wherein said first connection means are mounted in a mechanically decoupled manner in order to allow a different expansion of the two legs of said U-shaped configuration in the direction of the length of said legs.

37. The heat exchanger according to claim 23, wherein said cover is closed by an end-cover covering the bend of said U-shaped configuration of the channels of the modules at its end opposite to said first connection means.

38. The heat exchanger according to claim 23, wherein the modules are separated in said cover by spacing means along the outer periphery and/or the inner periphery of said U-shaped configuration of the group of channels of each module.

39. The heat exchanger according to claim 23, comprising support and spacing means between the successive modules.

* * * * *

UNITED STATES PATENT AND TRADEMARK OFFICE

CERTIFICATE OF CORRECTION

PATENT NO. : 7,044,207 B1
APPLICATION NO. : 10/048371
DATED : May 16, 2006
INVENTOR(S) : Guidat et al.

It is certified that error appears in the above-identified patent and that said Letters Patent is hereby corrected as shown below:

On the title page item (73), delete “Zie Pack”, and insert --ZIEPACK-- therefor.

Signed and Sealed this

Twenty-first Day of November, 2006

JON W. DUDAS
*Director of the United States Patent and Trademark Office*